United States Patent [19]

Brown et al.

[11] Patent Number: 4,824,293

[45] Date of Patent: Apr. 25, 1989

[54] RETAINING WALL STRUCTURE

[76] Inventors: Richard L. Brown, 905 40th St. S., Birmingham, Ala. 35222; George L. Morris III, 3507 Pine Ridge Rd., Birmingham, Ala. 35213

[21] Appl. No.: 34,720

[22] Filed: Apr. 6, 1987

[51] Int. Cl.[4] ..... E02D 29/02

[52] U.S. Cl. ..... 405/284; 405/262; 405/286

[58] Field of Search ..... 405/258, 262, 284, 285; 403/319, 331, 355, 381

[56] References Cited

U.S. PATENT DOCUMENTS

| | | | |
|---|---|---|---|
| 792,979 | 6/1905 | Fulghum | 403/331 |
| 4,324,508 | 4/1982 | Hilfiker et al. | 405/258 X |
| 4,343,572 | 8/1982 | Hilfiker | 405/284 |
| 4,389,133 | 6/1983 | Oberst | 403/331 X |
| 4,407,611 | 10/1983 | Murray et al. | 405/284 |
| 4,616,959 | 10/1986 | Hilfiker | 405/284 X |
| 4,661,023 | 4/1987 | Hilfiker | 405/262 |

FOREIGN PATENT DOCUMENTS

| | | | |
|---|---|---|---|
| 83722 | 4/1986 | Japan | 405/284 |
| 2100325 | 12/1982 | United Kingdom | 405/262 |

*Primary Examiner*—Randolph A. Reese
*Assistant Examiner*—John A. Ricci
*Attorney, Agent, or Firm*—Jennings, Carter, Thompson & Veal

[57] ABSTRACT

A construction for a retaining wall member utilizes a preformed channel in the member communicating through a slit formed between the channel and one face of the member for retention of a tieback utilized to affix the member to an underlying mass. The tieback may be retained by the mechanical interference between the walls of the slit and an enlarged portion of the tieback located within the channel. Alternatively, an interference rod may be inserted into the channel to retain the tieback.

9 Claims, 2 Drawing Sheets

RETAINING WALL STRUCTURE

FIELD OF THE INVENTION

The present invention relates generally to structures for supporting an underlying mass such as an earthen embankment or the like. More particularly, the present invention relates to an improved construction for panel members and anchors used in forming retaining walls for such underlying masses. In even greater particularity, the present invention may be described as a panel and anchor structure wherein said anchor is engagable within a preformed channel within said panel.

BACKGROUND OF THE INVENTION

Retaining wall structures utilizing a plurality of individual panels are well known. Conventionally, such panels are connected to the underlying mass by means of tiebacks which generally take the form of straps of various material such as metals, glass or polymers or of a webbed sheet of similar materials. Regardless of whether the strap or web type tieback is used, a portion of the tieback is embedded in the panel material when the panel is formed. Thus, either the entire tieback or a stub of tieback material forms a permanent protrusion from the rear of the panel. If a stub is retained, a longer tieback for anchoring is affixed thereto by bolting or weaving. Regardless of whether a full tieback or a stub is utilized, the protruding tieback material is a substantial hindrance in the storage and transportation of the manufactured panel prior to installation of the retaining structure. Further, the permanently affixed tieback material may be damaged in transport or handling, thereby rendering the entire panel member unusable. From the foregoing, it may be seen that the conventional panel and anchor structure leaves something to be desired in terms of efficiency, economy and utility.

SUMMARY OF THE INVENTION

It is the object of the present invention to provide a retaining wall structure which facilitates storage, handling and transportation of the component panels.

Another object of the invention is to provide a retaining wall structure which reduces the number of unusable panel members.

Yet another object of the invention is to provide a retaining wall structure, wherein the tieback may be easily secured to the panel at the installation site.

My invention achieves these objects through an advantageous new construction wherein each panel has formed therein during its fabrication a plurality of voids or channels which communicate with one face of the panel through a narrow slit. Each tieback is formed with an enlarged end portion which can be received within the channel but which has a thickness greater than the transverse width of the slit and thus cannot pass through the slit. The enlarged portion is inserted into the channel from one end thereof with the tieback extending through the slit for use as an anchor.

In a second embodiment, the slit is formed with a transverse width slightly greater than the thickness of the enlarged portion of the tieback such that the enlarged portion may be inserted into the channel through the slit or from one end as above. An interference rod is provided for insertion into the channel with the tieback in place. The interference rod reduces the effective width of the slit and thus prevents withdrawal of the tieback therethrough. In either embodiment, a cementitious or binding material may be used in the void to further adhere the tieback to the panel.

BRIEF DESCRIPTION OF THE DRAWINGS

A construction embodying features of my invention is depicted in the accompanying drawings which form a portion of this application and wherein.

DESCRIPTION OF THE PREFERRED EMBODIMENTS

Figure 1:
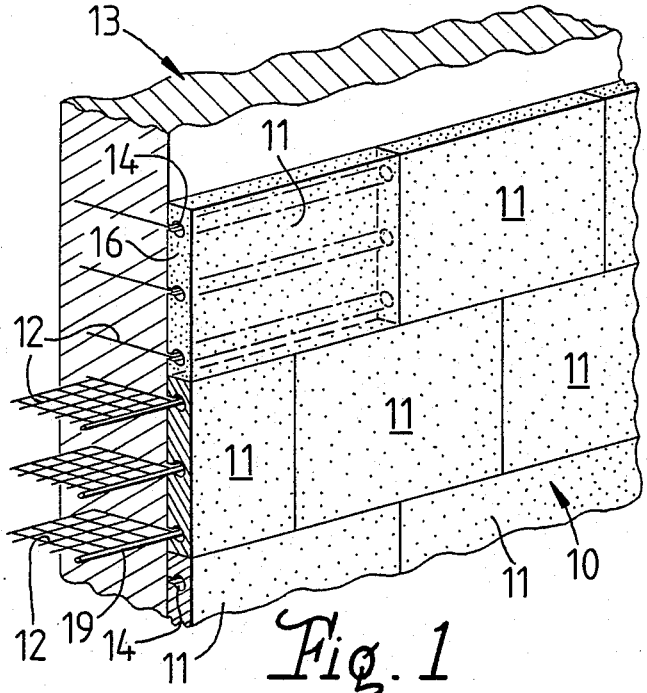
FIG. 1 is a fragmentary perspective view showing part of a retaining wall built with my invention.
Figure 2:
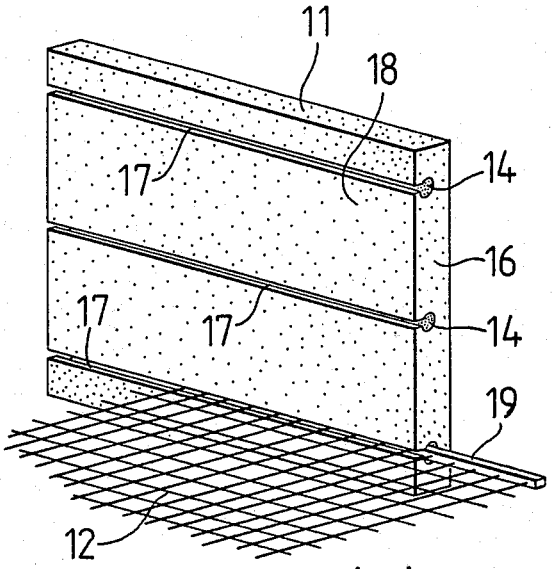
FIG. 2 is a perspective view of a panel and tieback combination illustrating one embodiment of my invention.
Figure 5:
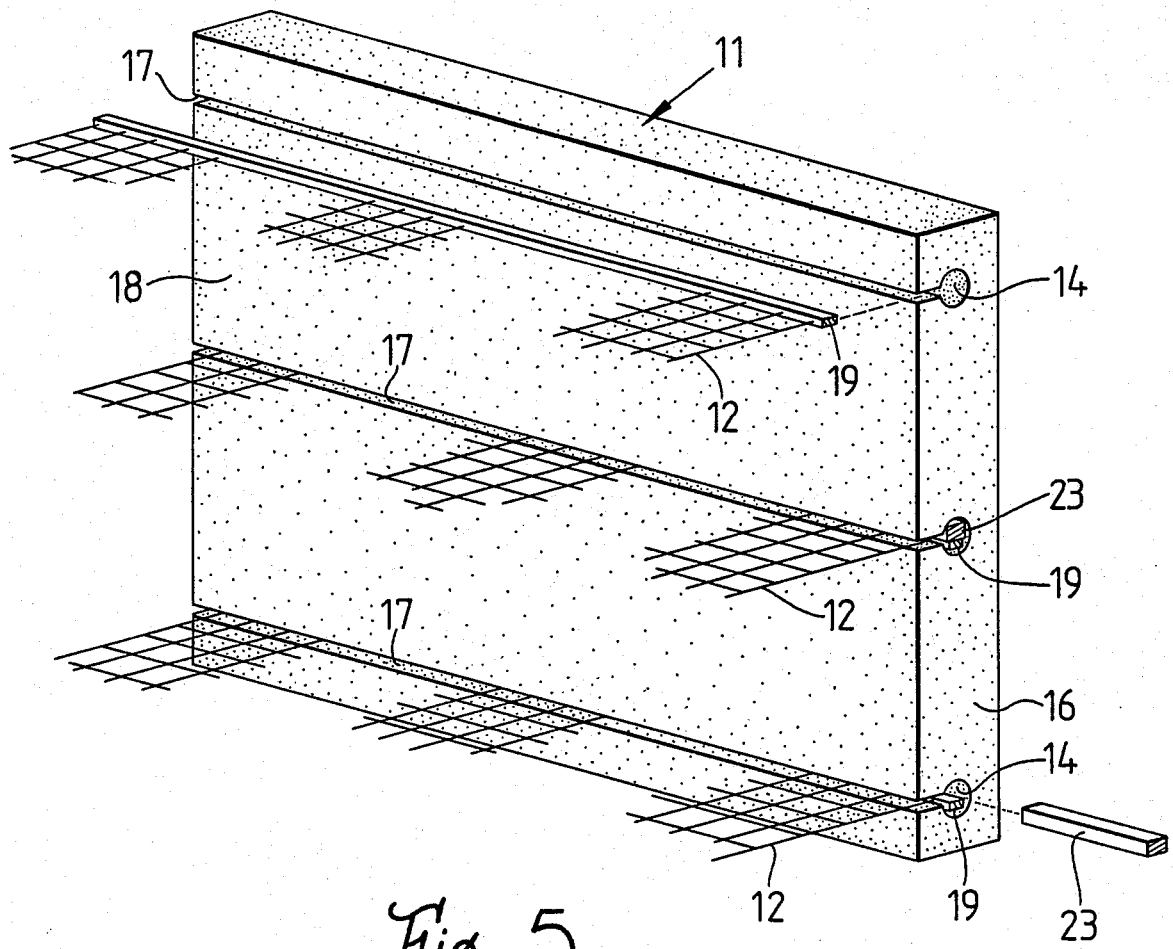
FIG. 5 is a perspective view of the panel, tieback, and retaining rod combination of the second embodiment of my invention.

Referring to FIG. 1, it may be seen that a retaining wall, shown generally at 10, is made up of a plurality of panels 11, which may be of any suitable geometric shape and which are depicted herein as rectangular. Each panel 11 has associated therewith a plurality of tiebacks 12, which anchor the retaining wall to the underlying mass 13, such as an earthen embankment. The tiebacks 12 are made of various materials such as metal, glass, polymer or the like with each material having characteristics which make it most suitable for a particular application, as is well known. Also tiebacks may be in the form of a web-like material as shown in FIGS. 1, 2 and 5 or may be strap-like members, as are well known.

Each panel 11 requires a certain number of tiebacks to be positioned in appropriate areas. The positioning of the tieback is not material to the instant invention, thus the Figures are merely illustrative of the connection of the tieback 12 to the panel.

Each panel 11 has formed at least one channel 14, extending therethrough and opening to at least one side 16 of the panel 11. An elongated slit 17 is cooperatively formed with each channel 16 and opens along the width of one face 18 of the panel 11. The slit 17 is appreciably smaller in width than is the associated channel 14. It is to be understood that the panels 11 can be made from any material suited for the intended usage, including but not limited to wood, polymer, concrete, or metal. The panels 11 may be made in castings, whereupon the channels 14 and slits 17 are readily formed through the use of appropriately shaped and displaced mold elements.

Figure 3:
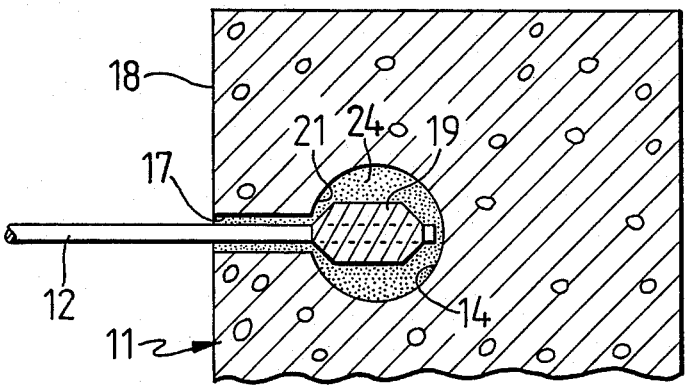
FIG. 3 is a partial side elevation showing a tieback retained in a panel channel in one embodiment of my invention.

Referring to FIG. 3, it may be seen that each tieback 12 has formed on one end, or along one side thereof, an enlarged portion 19 which can be confined within channel 14. In this embodiment, the slit 17 is restricted such that its transverse dimension is less than the thickness of the enlarged portion 19, thus the enlarged portion 19 can only be inserted into the channel or removed therefrom by axial movement in the channel 14. The tiebacks 12 are held against movement through the slit 17 by mechanical interference of the enlarged portion 19 and the restricted slit 17 which is formed intermediate a pair of interior walls 21 which define a bearing surface against which the enlarged portion 19 abuts.

Figure 4:
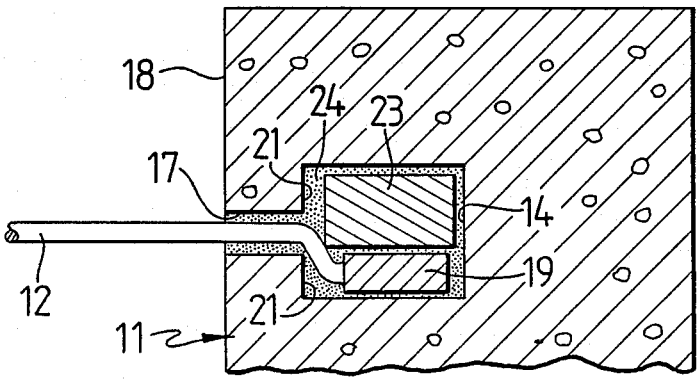
FIG. 4 is a partial side elevation showing a tieback retained in a panel channel by an interference rod in a second embodiment of my invention.

In the embodiment shown in FIGS. 4 and 5, the slit 17 is slightly wider than the thickness of the enlarged portion 19 such that the enlarged portion 19 can pass through the slit 17. To prevent withdrawal of the tieback 12 from the panel, an interference rod 23 is inserted into the channel 14 after the tieback 12 is positioned therein. The interference rod 23 must be of such a configuration as to cooperate with the interior walls 21 to effectively reduce the width of the slit 17 or to form a restricted passageway such that the enlarged portion 19 cannot be withdrawn through the slit 17. The tieback 12 may be preformed in a shape similar to that shown in FIG. 4 as needed, depending on the material selected for use as a tieback. It is also to be understood that the channels 14 may be of any suitable shape which will accommodate the enlarged portion 19 and provide for interference retention of the tieback 12 therein. In either embodiment, a cementitious or binding material 24 may be used within the channel to adhere the tieback to the panel.

It may be seen from the above that the present invention allows the production of panel members which can be readily stacked for transportation or storage without having to make allowance for extending tieback stubs. Also damage to such stubs or to personnel or property by such stubs is eliminated. The tiebacks 12 can be as easily and readily affixed to the panel as can conventional tiebacks, thus the present invention provides a substantially more efficient retaining wall construction.

While I have shown my invention in two forms, it will be obvious to those skilled in the art that it is not so limited but is susceptible of various changes and modifications without departing from the spirit thereof.

What I claim is:

1. In a retaining wall construction utilizing a plurality of panels as retainers for an underlying mass with each panel secured to said mass by anchors embedded in said mass, the improvement comprising:

(a) a plurality of channels formed in said panels with each channel communicating with the side of said panel adjacent said underlying mass via a slit extending along said channel; and (b) means for securing one end of said anchor within said channel to prevent withdrawal of said anchor through said slit with said slit having a transverse width slightly greater than the thickness of said anchor proximal said one end with said one end having an increased terminal thickness and smaller than the transverse width of said channel and said means for securing comprising an interference rod inserted within said channel such that the effective width of said slit is reduced.

2. The improvement as defined in claim 1 wherein said channel has interior walls adjacent said slit cooperatively formed to retain said one end adjacent said interference rod.

3. The improvement defined in claim 2 wherein said anchor comprises a generally planar mesh wherein said one end has an enlarged portion formed thereon for insertion into said channel.

4. The improvement defined in claim 2 further comprising sealing means for insertion within said channel about said one end and said retaining rod for adhering said anchor and said rod with said channel.

5. The improvement defined in claim 1 wherein said channel has interior walls adjacent said slit cooperatively formed to retain said enlarged portion within said channel.

6. The improvement defined in claim 5 further comprising sealing means for insertion within said channel about said one end for adhering said one end within said channel.

7. Apparatus for use in a retaining wall construction wherein said retaining wall supports an underlying mass comprising:

(a) a panel member having a plurality of elongated channels formed therein, each channel communicating with one side of said panel member through an elongated slit;

(b) tieback means for anchoring said panel member to said underlying mass, said tieback means having an enlarged portion insertable into said channel through said slit; and (c) means for retaining said tieback means within said channels comprising an interference rod insertable longitudinally within said channel for reducing the effective width of said slit.

8. Apparatus as defined in claim 7 further comprising means for cementitiously binding said interference rod and said enlarged portion within said channel.

9. The improvement as defined in claim 7 wherein said channel has interior walls adjacent said slit cooperatively formed to retain said one end adjacent said interference rod.

* * * * *